US010849444B1

(12) United States Patent
Matuka et al.

(10) Patent No.: US 10,849,444 B1
(45) Date of Patent: Dec. 1, 2020

(54) PORTABLE PLATE, CUP AND SILVERWARE

(71) Applicants: Margit Matuka, West Hollywood, CA (US); Margaret D Woods, West Hollywood, CA (US); Eva K Matuka, West Hollywood, CA (US)

(72) Inventors: Margit Matuka, West Hollywood, CA (US); Margaret D Woods, West Hollywood, CA (US); Eva K Matuka, West Hollywood, CA (US)

( * ) Notice: Subject to any disclaimer, the term of this patent is extended or adjusted under 35 U.S.C. 154(b) by 0 days.

(21) Appl. No.: 16/679,061

(22) Filed: Nov. 8, 2019

(51) Int. Cl.
*A47G 19/02* (2006.01)

(52) U.S. Cl.
CPC ..... *A47G 19/065* (2013.01)

(58) Field of Classification Search
CPC ..... B65D 1/34; A47G 23/06
USPC ..... 220/761; 206/562, 564, 565
See application file for complete search history.

(56) References Cited

U.S. PATENT DOCUMENTS 2,723,068 A 11/1955 Ettwein
4,746,057 A * 5/1988 Wagner ..... A47G 19/065 220/574
4,927,024 A * 5/1990 Lloyd ..... A47G 19/10 206/562
5,076,438 A 12/1991 Aronson
5,119,967 A 6/1992 Ercolani
5,222,622 A * 6/1993 Laske, Jr. ..... A47G 19/06 206/541
5,240,136 A 8/1993 Patterson et al.
5,353,952 A 10/1994 Donche
5,607,077 A 3/1997 Torkelson
5,803,305 A 9/1998 Perlis et al.
6,401,927 B1 6/2002 Sorensen et al.
6,971,613 B2 12/2005 Shendelman
9,549,629 B2 1/2017 Bourget et al.
2011/0266316 A1 11/2011 Ghalib et al.
2012/0248124 A1 10/2012 Mitri et al.
2013/0233864 A1 9/2013 Kilpatrick
2015/0182054 A1 7/2015 Shames
2015/0250338 A1 9/2015 Blais
2015/0282655 A1 10/2015 Donovan
2015/0359368 A1* 12/2015 Bachar ..... A47G 23/0625 206/459.5
2016/0058222 A1 3/2016 Batten

FOREIGN PATENT DOCUMENTS

WO WO 93/21077 10/1993
WO WO 2017/062018 A1 4/2017

* cited by examiner

*Primary Examiner* — Jeffrey R Allen
(74) *Attorney, Agent, or Firm* — McConnell Law Firm; Robert McConnell

(57) ABSTRACT

A novel portable plate, cup and silverware device that improves portability, usability and stability is disclosed. The present invention includes a plate of the type used for food at meals, gatherings, parties and the such. The plate includes an adjustable strap, hidden in a compartment under an openable and closeable cover on the underside of the plate, to provide stability while a user holds the plate. The plate also includes a cup holder on the top of the plate, a cup with an internal straw and a lid, as well as comfort grip utensils that can be attached and detached from the rim of the plate. The device can be manufactured from multiple reusable, disposable or recyclable materials.

11 Claims, 9 Drawing Sheets

FIG. 6A
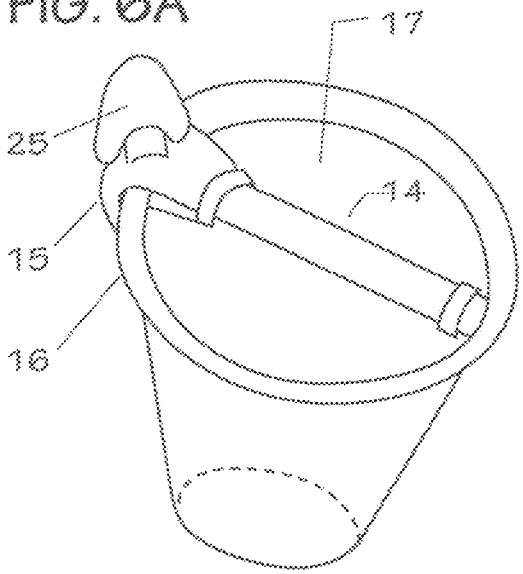
FIG. 6B
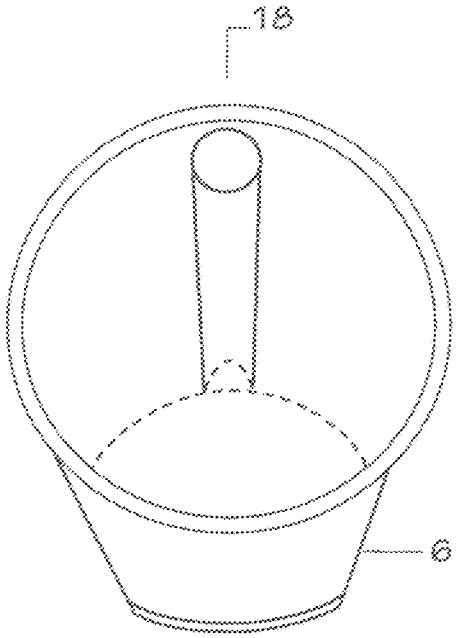
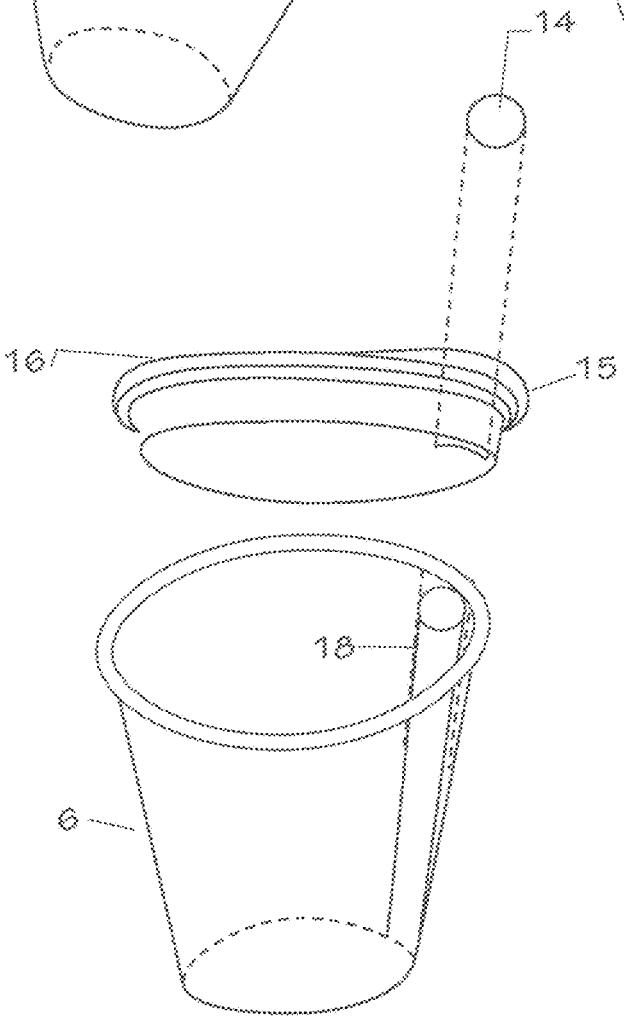
FIG. 6C

PORTABLE PLATE, CUP AND SILVERWARE

BACKGROUND OF THE INVENTION

Field of the Invention

The present invention relates to products commonly known as "party goods" for use at parties, celebrations, conventions, groups or other gatherings of people where food and drinks are served and people socialize while standing, walking and/or talking. These goods typically include plates, cups and silverware made of paper, plastic, compostable materials and other organic, disposable or recyclable material. It is a well known challenge at such gatherings to hold a plate, a drink cup and still manage to consume the food on the plate, all without dropping any items or spilling. The disclosed invention provides a novel apparatus for a portable plate, cup and silverware that allows the user to use one hand to support the apparatus with an adjustable hand strap located in a closable compartment on the underside of the plate. With the compartment cover in the closed position, the cover is flush against the bottom of the plate and allows the plate to sit flat on a table as any other existing plate. The disclosed invention also includes a locking cup attachment receptor and locking cup holder that securely lock multiple sizes of cups into place on the plate. Another element of the invention includes a novel cup, lid and straw apparatus that includes a stowable straw and a cover for the lid opening. Further, the present invention includes utensils formed with comfort grip handles easy gripping, including a channel formed in said handle that can be attached and detached from a complementary edge of the plate. This apparatus can be held and supported securely with one hand while the user's other hand is free to eat or drink with either the attached utensil or attached cup. The user can stably and safely hold the plate with one hand while in motion, standing, talking or walking. The novel cup apparatus locks cups of multiple sizes to the plate for stability and the lid and straw apparatus prevent spills. The disclosed invention can be made from any material suitable for use in disposable, recyclable or reusable plates, cups and silverware, including new, organic or recycled paper, plastic, glass or ceramic with an adjustable strap made of elastic, rubber, foam, paper or any suitable material.

Description of Background Art

A variety of other solutions are well known in the art and are briefly outlined in this section.

A number of alternative plate handles or grasping devices are well known in the art. These include collapsible non-adjustable handles on the bottom of the plate, hand holes formed through the plate for parts of the user's hand to grasp, horseshoe non-adjustable shaped handles for the users hand formed on the underside of the plate, recesses on the underside of the plate with hand shaped contours, cup holders with integrated hand grips, wedges or screw devices that attach the plate to a user's glass so that the glass can be used as a handle as well as a variety of straps attached to the underside of the plate for the user's hand. Many of these solutions prevent the plate from laying flat when placed on a table or fail to provide adjustable support for variably sized hands.

Recesses on the top of plates to hold cups, food and a variety of other items are also well known in the art. Slots cut in plates, as holders for the stems of stemware are also well known. The novel cup apparatus disclosed in the present invention is not known in the art.

A variety of attachment and storage means are also known in the art, including slots for silverware, clips for silverware and attachable/detachable silverware.

The novel combination of the elements of the present invention are not known in the above prior art.

OBJECTS OF THE INVENTION

It is an object of the invention to provide a plate that can be easily held and managed with one hand.

It is another object of the invention to allow a user to hold the plate with one hand while in motion, standing, or walking.

It is another object of the invention to provide an adjustable and extendable strap that can be worn around the plate holder's hand to stabilize the plate.

It is another object of the invention to provide a cover that can be opened and closed, that covers a compartment hiding the adjustable and extendable strap.

It is another object of the invention to provide a closeable cover that lies flush and flat along the bottom of the plate allowing it to sit flat on a table.

It is another object of the invention to provide an ornamental design or branding under the openable and closeable cover.

It is another object of the invention to provide a locking cup attachment receptor on the upper surface of the plate.

It is another object of the invention to provide a cup that can be fixed in place and removed from a locking cup holder that is locked into the locking cup attachment receptor on the top of the plate to prevent tipping, dropping and spilling the cup when attached to the plate.

It's another object of the invention to provide a locking cup holder that can accommodate multiple sizes of cup.

It is another object of the invention to provide a cup with a lid, an internal straw, an external straw, a hole in the lid, and a straw storage location.

It is another object of the invention to provide a straw attachable and detachable from the lid of the cup and can be placed in the hole on the lid to extend the internal straw and drink liquid.

It is another object of the invention to provide a lid for the cup that can be attached or removed from the cup to prevent spills.

It is another object of the invention to provide silverware that can be attached and detached to the edge of the plate. In a preferred embodiment of the silverware, each utensil has a comfort grip handle and channel formed in said handle that is sized to couple with a similarly sized attachment edge on the edge of the plate.

It is another object of the invention to provide an ornamental design or branding on top of the plate or within the inside of the locking cup attachment receptor.

It is another object of the invention to provide a portable plate, cup and silverware combination that can be made out of any disposable materials such as paper, cardboard, plastic, compostable material, recycled materials or can be made out of any reusable materials such as glass, plastic, metal or ceramic.

SUMMARY OF THE INVENTION

The present invention discloses a novel portable plate, cup and silverware combination. The invention is described as a "party good" for utilizing while attending parties, celebrations, conferences, groups, and other gatherings of people where people eat and drink while standing, walking and/or talking. A preferred embodiment is disclosed that is based on a complete working prototype of the device, however the disclosure is not intended to be limited by this preferred embodiment.

A preferred embodiment of the plate of the disclosed invention is designed to be stably held with one hand while the user is standing, walking or in motion and includes an adjustable, extendable strap on the underside of the plate for the user to place their hand through to provide additional support. This support strap is hidden in a compartment under an openable and closeable cover on the back side of the plate.

A preferred embodiment of the disclosed invention includes a plate with a cover located on the underside. The cover can be opened or closed and covers an adjustable, extendable strap also attached to the underside of the plate. The strap is worn around the user's hand and provides support and stability for the plate for users with hands of a variety of sizes. The disclosed cover closes flat against the bottom of the plate allowing the plate to sit flat on a table and to be used as a normal plate. This embodiment further discloses including an ornamental design or branding that is revealed when the cover is opened.

A preferred embodiment of the disclosed invention also includes a locking cup attachment receptor on the upper surface of the plate. The cup attachment receptor includes a locking mechanism within the receptor that when coupled with the included locking cup holder, locks cup of multiple sizes in place to prevent dropping or tipping the cup. To engage the locking mechanism, the user places the locking cup holder in the cup attachment receptor and rotates the locking cup holder to couple it to the locking mechanism, thus locking it in place. The locking cup holder is expandable to accommodate multiple cup sizes. The cup can be placed in the locking cup holder when the sleeve is locked in the locking cup attachment receptor or when it is not so installed. The inside of the cup attachment receptor can also include an ornamental design and/or branding.

A novel cup with lid and built in and extendable straw apparatus is disclosed as part of the present invention. The cup lid includes a lid opening disposed such that an external straw, when installed in the drinking position, is coupled with an internal straw through the lid opening. The external straw can also be stored in an external straw holder disposed on the top of the lid. The cup apparatus also includes a cover that can be installed in the lid opening when the external straw is not installed. When installed in the drinking position, the external straw allows the user to drink liquids in the cup while standing, walking or in motion with substantially reduced risk of spilling the liquid in the cup. When in the straw is installed in storage position and the cover installed in the lid opening, the cup can be moved with little risk of splashing or spilling of a liquid contained therein. When removed from the locking cup holder the cup can be used as an ordinary cup while holding hot or cold liquids or other items suitable to be held in a cup. The user can use the novel cup in multiple configurations: with the external straw installed, drinking liquids directly through the opening in the lid or without the lid installed.

The disclosed invention also includes a means for attaching silverware to the edge of the plate. This silverware can include forks, knives, spoons, "sporks" or other common utensils. The handle of the silverware is designed with a comfort grip enabling a secure and stable grip. The handle also includes a channel that can be attachably fixed to a similarly sized edge on the outer rim of the plate. With this functionality, the plate user can attach their silverware to the plate so that the user can have their hand free for other activities. The silverware can be reusable or disposable.

A preferred embodiment of the disclosed invention can be manufactured out of any suitable disposable or reusable materials. Suitable disposable materials include but are not limited to paper, cardboard, plastic, compostable materials, recycled materials or any organic materials. Suitable reusable materials include but are not limited to plastic, glass, metal and ceramic. Suitable materials for the adjustable strap include elastic, rubber, plastic, paper, foam or any other material suitable for formation of a strap.

BRIEF DESCRIPTION OF THE DRAWINGS

FIG. 6A Shows the cup lid with the straw in the stowed position.

FIG. 6B Shows the cup with the lid removed and the internal straw exposed.

FIG. 6C Shows the cup with the lid above the cup and the coupling mechanism between the external straw and internal straw exposed.

DESCRIPTION OF THE PREFERRED EMBODIMENT

Figure 1A:
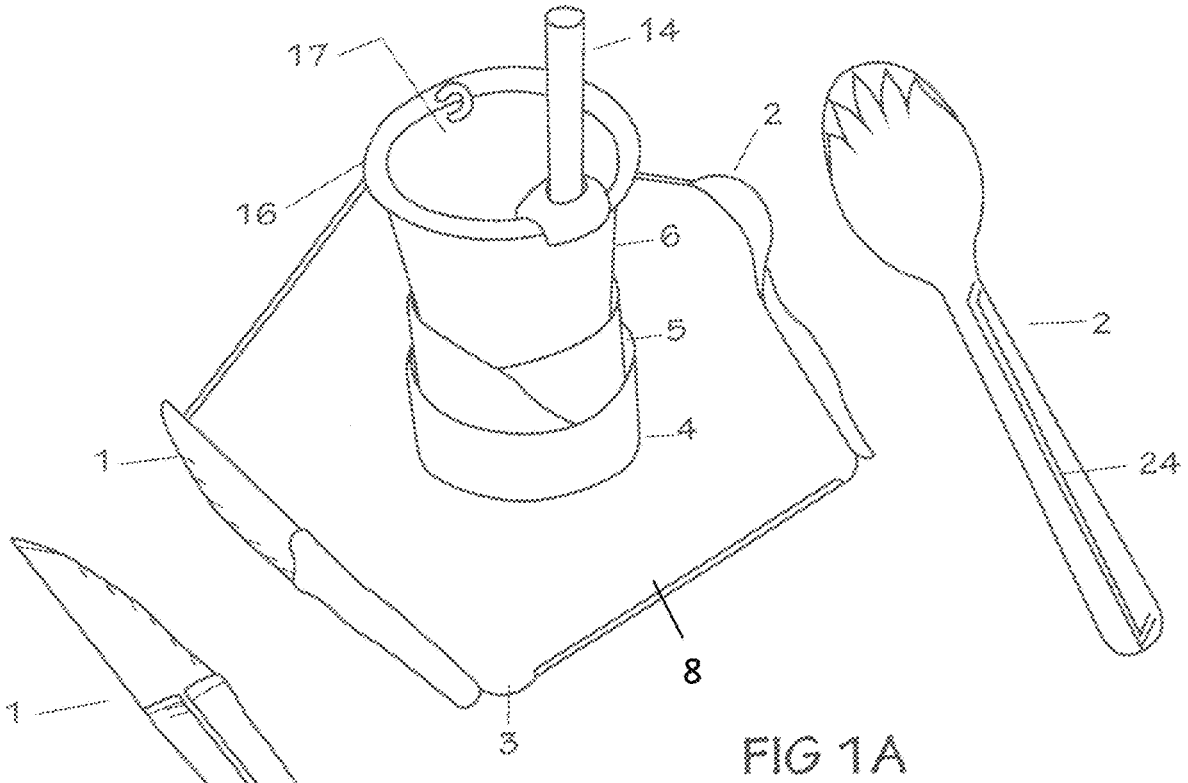
FIG. 1A Shows the assembled portable plate, cup and silverware apparatus FIG. 1B Shows the assembled portable plate, cup and silverware apparatus without silverware attached and the straw in the stowed position.

The challenge of holding a plate of food, a cup and silverware all while trying to balance the plate, cup and utensils, consume the food and make conversation is an age old problem. It's extremely difficult to manage the plate while also holding a cup and utensils. Party goers (and those attending other gatherings where food is consumed while standing or in motion) often resort to stacking their plate on top of their cup, which is inherently unstable, or placing their cup down on a flat surface near them, provided one is available. The first approach comes with significantly decreased stability and heightened risk of a spill, and the other comes with a risk of losing one's drink in a sea of similar looking cups or glasses, if one can find a place to set it down at all. The above examples are but two of many possible challenging, negative or even embarrassing outcomes that can occur in such circumstances.

The prior art is littered with attempted solutions to this problem, none of them as effective as the disclosed invention. A number of alternative plate handles or grasping devices are well known in the art. These include collapsible non-adjustable handles on the bottom of the plate, hand holes formed through the plate for parts of the user's hand to grasp, non-adjustable horseshoe shaped handles for the users hand formed on the underside of the plate, recesses on the underside of the plate with hand shaped contours, cup holders with integrated hand grips, wedges or screw devices that attach the plate to a user's glass so that the glass can be used as a handle as well as a variety of straps attached to the underside of the plate for the user's hand.

Recesses on the top of plates to hold cups, food and a variety of other items are also well known in the art. Slots cut in plates, as holders for the stems of stemware are also well known.

A variety of attachment and storage means are also known in the art, including slots for silverware, clips for silverware and attachable/detachable silverware.

A preferred embodiment of the disclosed invention is described in relation to the attached figures and claims below. This is but one embodiment and there are many other variations and embodiments that comport with the patent claims.

As will be discussed in the detailed description below, the disclosed invention provides an adjustable and extendable strap contained within a compartment on the underside of the plate. The user can place their hand through the adjustable and extendable strap to provide stability to the plate while walking, standing or in motion. The compartment on the underside of the plate includes a closeable cover that lies flat and flush with the bottom of the plate and allows it to be used on a table as a normal plate.

Further, the disclosed invention includes a cup holding apparatus, outlined in detail below, that comprises a locking cup attachment receptor and a locking cup holder. This unique apparatus allows the user to lock a cup in place on the top of the plate so that it is stable and secure while the user holds the plate. This functionality prevents spills.

A novel cup apparatus is disclosed as part of the disclosed invention. This cup includes an internal straw, a lid with a hole, an external straw, and a straw holder located on the lid. The hole on the lid is disposed to provide connection between the internal and external straws for drinking liquid. The straw can be stowed and liquids consumed directly through the hole. The hole can be closed with a provided hole stopper.

In the preferred embodiment of the disclosed invention, novel silverware with a comfort grip handle that allows for secure and comfortable holding of the utensils are provided. The utensil handle includes a channel that can be coupled with a complementary edge on the rim of the plate to attach and detach the utensils from the plate. In this way, the utensils can be securely attached and stowed to the plate when the user is holding the plate with one hand.

The disclosed invention can be used for a variety of purposes, including parties, celebrations, weddings, showers and other social gatherings as well as business related functions like conferences, meetings and other events. The disclosed invention can be manufactured out of any suitable disposable or reusable material, some of which include paper, cardboard, recycled materials, compostable materials, plastic, glass, metal and ceramic. The invention is not meant to be limited in any way by the disclosed preferred embodiment.

The disclosed preferred embodiment can be manufactured in a variety of disposable or reusable materials using production tools, systems and methods well known in the art.

FIG. 1A shows the complete portable plate, cup and silverware product, fully assembled. Utensils knife 1 and a spork 2 are attachable and detachable from the outer rim of plate 3 by coupling with edge 8. While this figure shows spork 2 and knife 1, any number of suitable utensils could be attached including spoons, forks, skewers, chopsticks or any type of serving utensil. Locking cup attachment receptor 4 is shown attached or formed on the surface of plate 3. Shown locked into locking cup attachment receptor 4 is locking cup holder 5. In the preferred embodiment, locking cup attachment receptor 4 couples with locking cup holder 5 when the user places locking cup holder 5 in locking cup attachment receptor 4 and twists locking cup holder 5 rotationally. When locking cup holder 5 is rotated within locking cup attachment receptor 4, locking cup holder 5 locks into place and provides sufficient force on the exterior of cup 6 to secure it in place. The coupling mechanism for locking cup attachment receptor 4 and locking cup holder 5 is shown in a later figure.

Figure 1B:
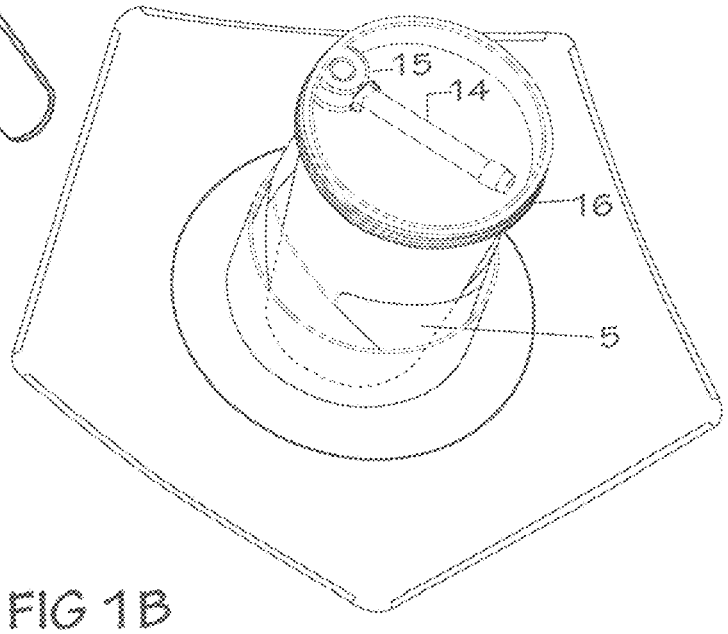

FIG. 1B shows the complete portable, cup, plate and silverware product as in FIG. 1A without utensil 1 or 2 attached. Cup 6 is covered by lid 16 and straw 14 is shown in the stowed position.

The components of the disclosed invention including utensils 1, 2 plate 3 and cup 6 can be formed of any suitable disposable, recyclable or reusable material such as plastic, paper, wood, compostable/recycled material, metal, glass, ceramic or any other suitable material known in the art for manufacturing such articles.

Figure 2A:
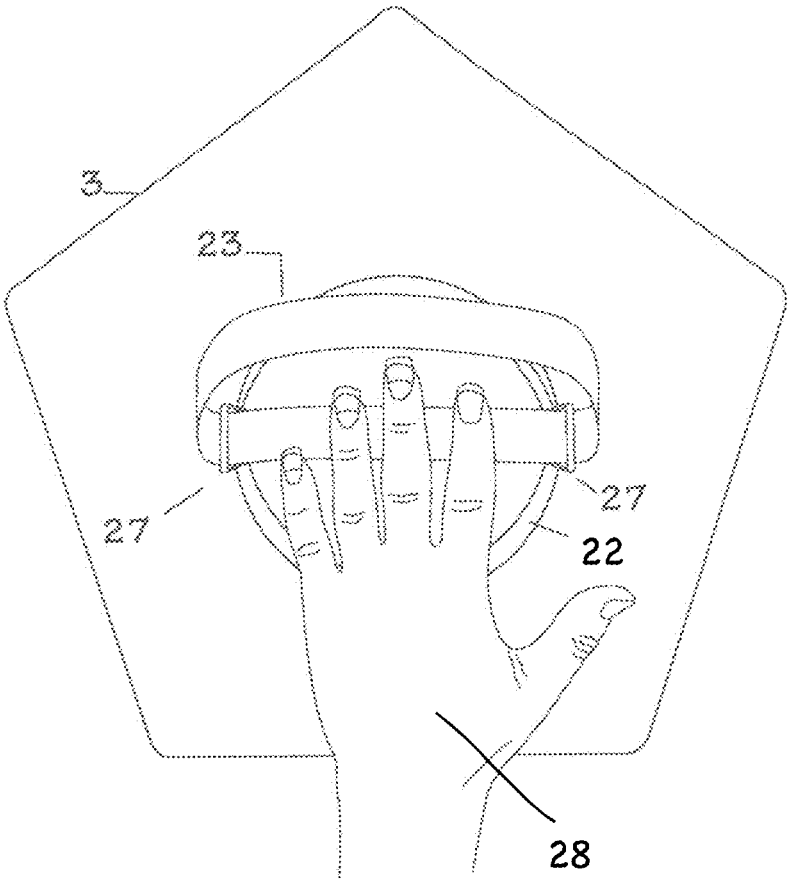
FIG. 2A Shows the underside of the plate with the adjustable strap exposed and user's hand ready to be placed through the strap.

FIG. 2A provides a view of the underside of plate 3 with removable cover 19 (shown in a later figure) open and showing the contents of compartment 22. Adjustable strap 27 is contained within compartment 22. A user of plate 3 would slide their hand 28 through adjustable strap 23 to provide stability and security while holding the plate from its bottom side. User can adjust the size of adjustable strap 23 by extending or stowing the additional strap stowed in compartment 22. Clips 27 are attached to plate 3 and allow adjustable strap to be adjusted to different lengths by extending or stowing additional strap length. In the preferred embodiment, adjustable strap 23 is made of elastic, but other suitable materials may be used to similar effect.

Figure 2B:
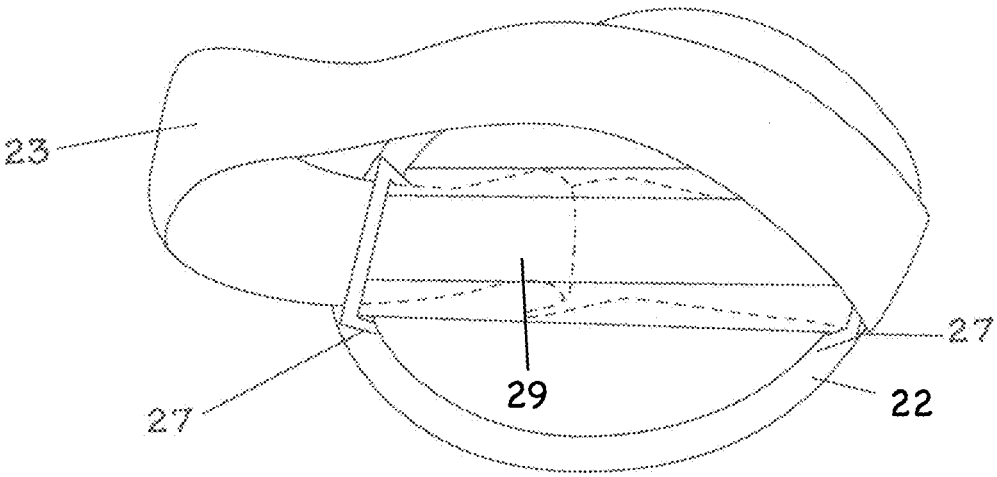
FIG. 2B shows the adjustable strap with the extendable portion of the strap stowed.

FIG. 2B shows a second view of adjustable strap 23, additional strap material 29 is tucked under the strap and stowed for easy removal and adjustment within compartment 22.

Figure 2C:
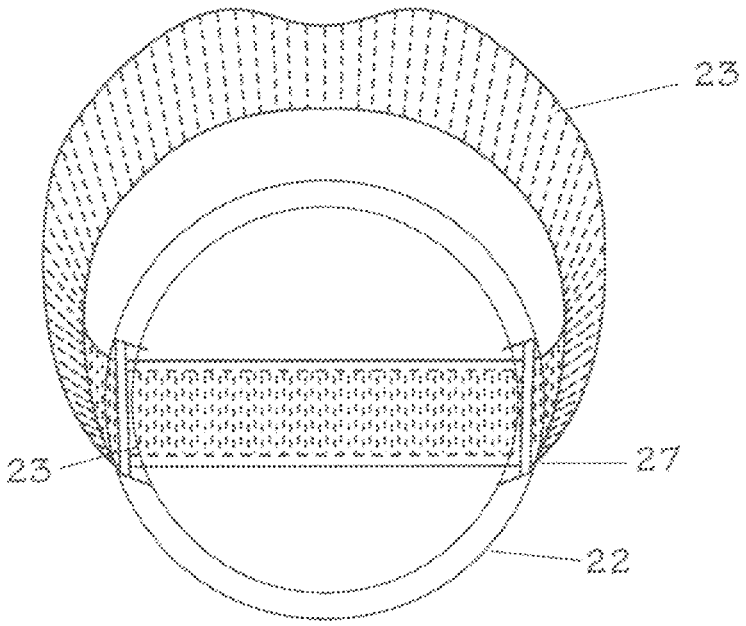
FIG. 2C shows the adjustable strap with the extendable portion fully extended.

FIG. 2C shows a detailed view of adjustable strap 23 material, in the preferred embodiment made of elastic material, shown in compartment 22 with clips 27.

Figure 2D:
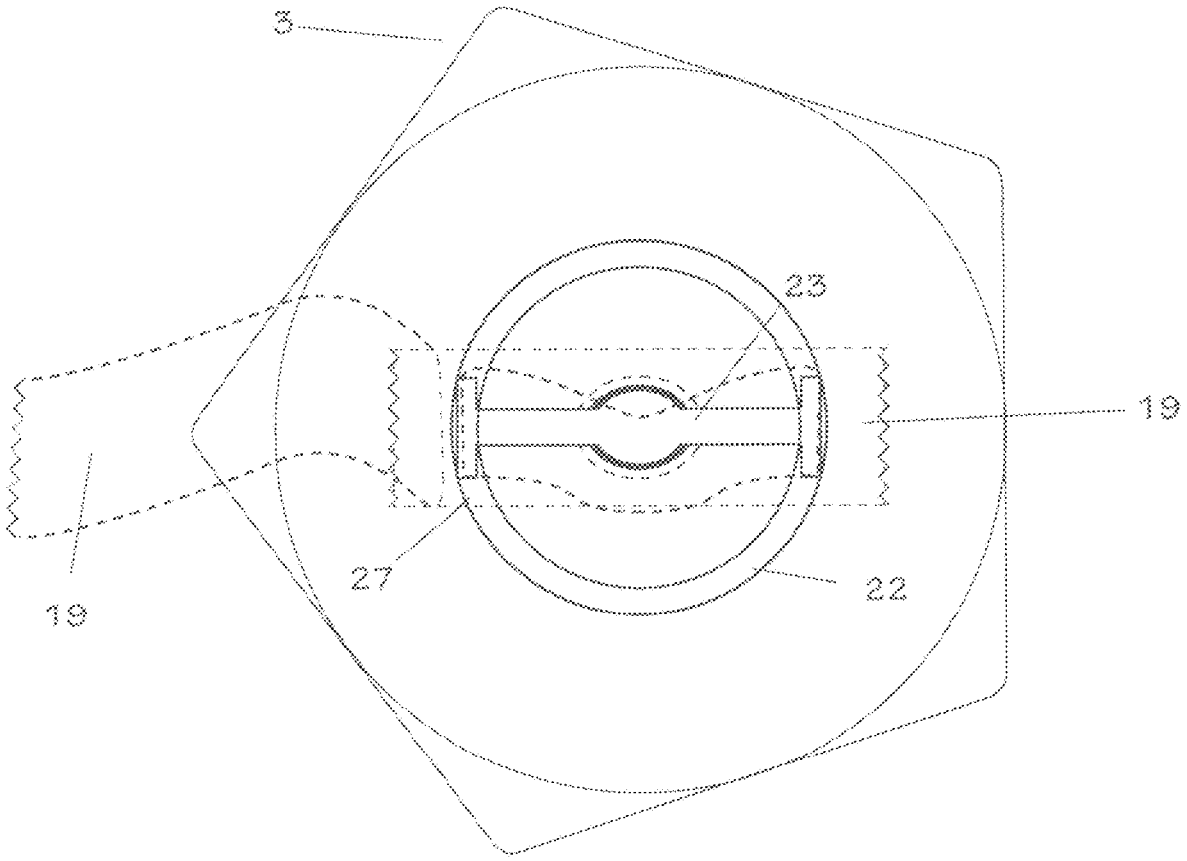
FIG. 2D shows the underside of the plate with the removable cover open.

FIG. 2D shows a view of the underside of plate 3 with removable cover 19 shown in both its open and closed positions. In the preferred embodiment, removable cover 19 is made of transparent re-attachable tape but can be manufactured out of any other suitable material. In this view, strap 23 in stored in compartment 22 and is ready to be removed to allow it to placed around user's hand 28 to stabilize the plate. Clips 27 secure adjustable strap 23 in place and allow it to be adjusted by extending or stowing additional strap material 29 (not shown).

Figures 3, 3A:
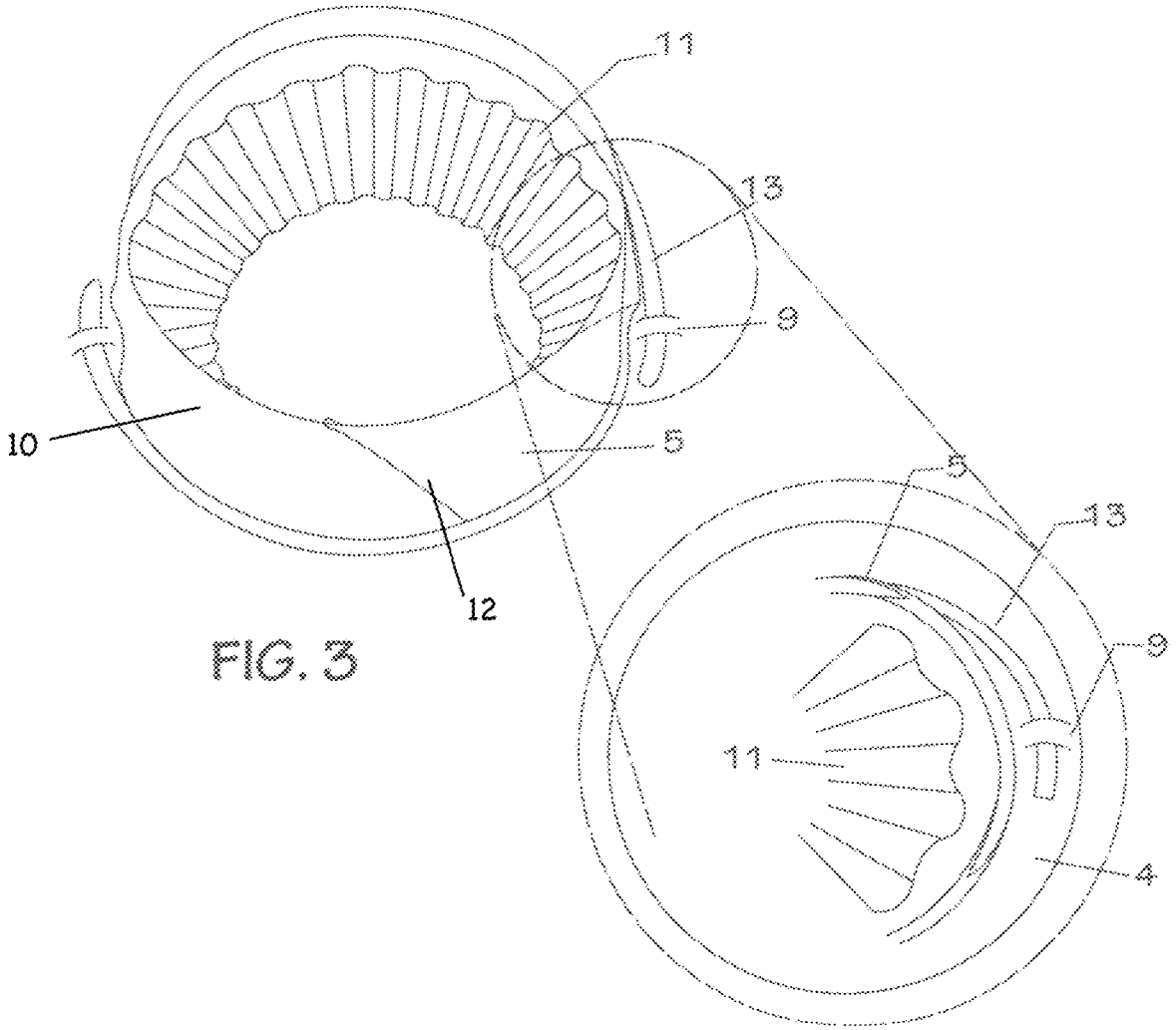
FIG. 3 Shows a view of the adjustable locking cup holder.
FIG. 3A Shows a detailed view of the locking mechanism.

FIGS. 3 and 3A shows a detailed view of the locking cup holder 5 including all its component parts and mechanisms. The mechanism that locks the locking cup holder 5 into the locking cup receptor 4 operates by sliding locking tab 13 into corresponding locking slot 9. In the disclosed preferred embodiment, locking tab 13 and locking slot 9 slide together when the user rotates the locking cup holder 5 clockwise. When locking tab 13 slides into locking slot 9, the tab and slot lock together, thus locking the locking cup receptor 4 and locking cup holder 5 together. These locking connectors can be formed of cardboard, plastic, paper or any other suitable material.

In the disclosed preferred embodiment, outer cup sleeve 10 is formed of cardboard/paper and includes gripping aperture 12. Inner cup sleeve 11 is formed of corrugated cardboard and grips cup 6 when placed in the locking cup holder 5. Gripping aperture 12 opens to allow the base of cup 6 to slide into locking cup holder 5. Once in the sleeve, gripping aperture 12 closes to allow the outer cup sleeve 10 to grip the upper part of cup 6. Inner cup sleeve 11 grips the lower base portion of the cup. In concert, inner cup sleeve 11 and outer cup sleeve 10 provide sufficient grip to hold cup 6 in place. Locking cup holder 5, outer cup sleeve 10 and gripping aperture 12 allow multiple sized cups to be held securely in the device.

Figure 4:
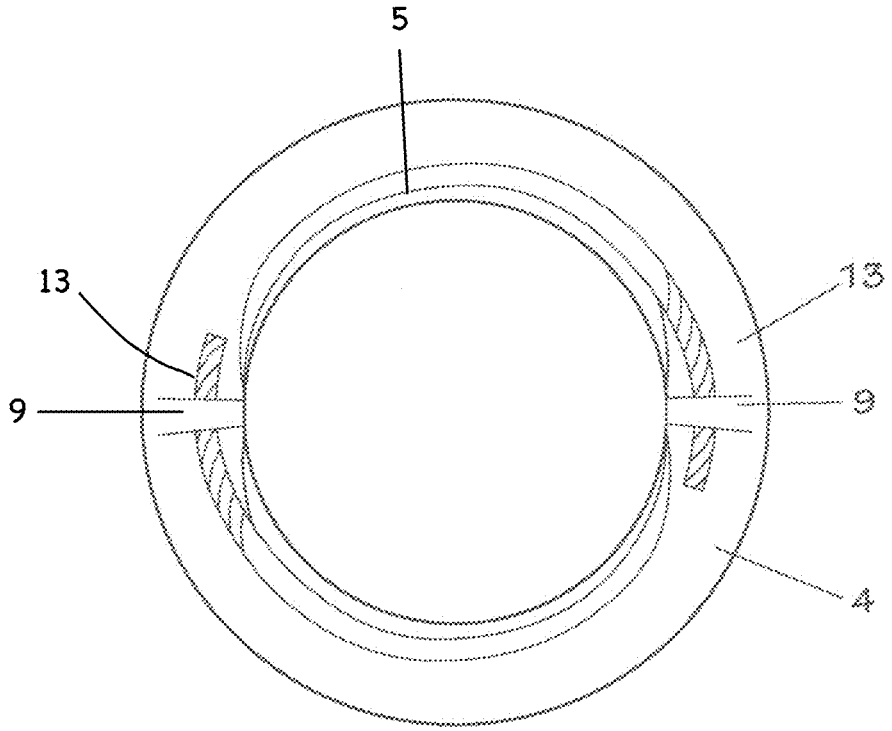
FIG. 4 Shows a top view of the cup attachment receptor and locking cup holder.

FIG. 4 Shows a top view of the locking cup attachment receptor 4 with the locking cup holder 5 installed. Locking slot 9 is shown on either side of the outer radius of the receptor. Locking tab 13, when rotated clockwise by the user, slides into locking slot 9. The coupling of locking tab 9 and locking slot 13 securely attaches locking cup holder 5 to locking cup attachment receptor 4.

Figure 5:
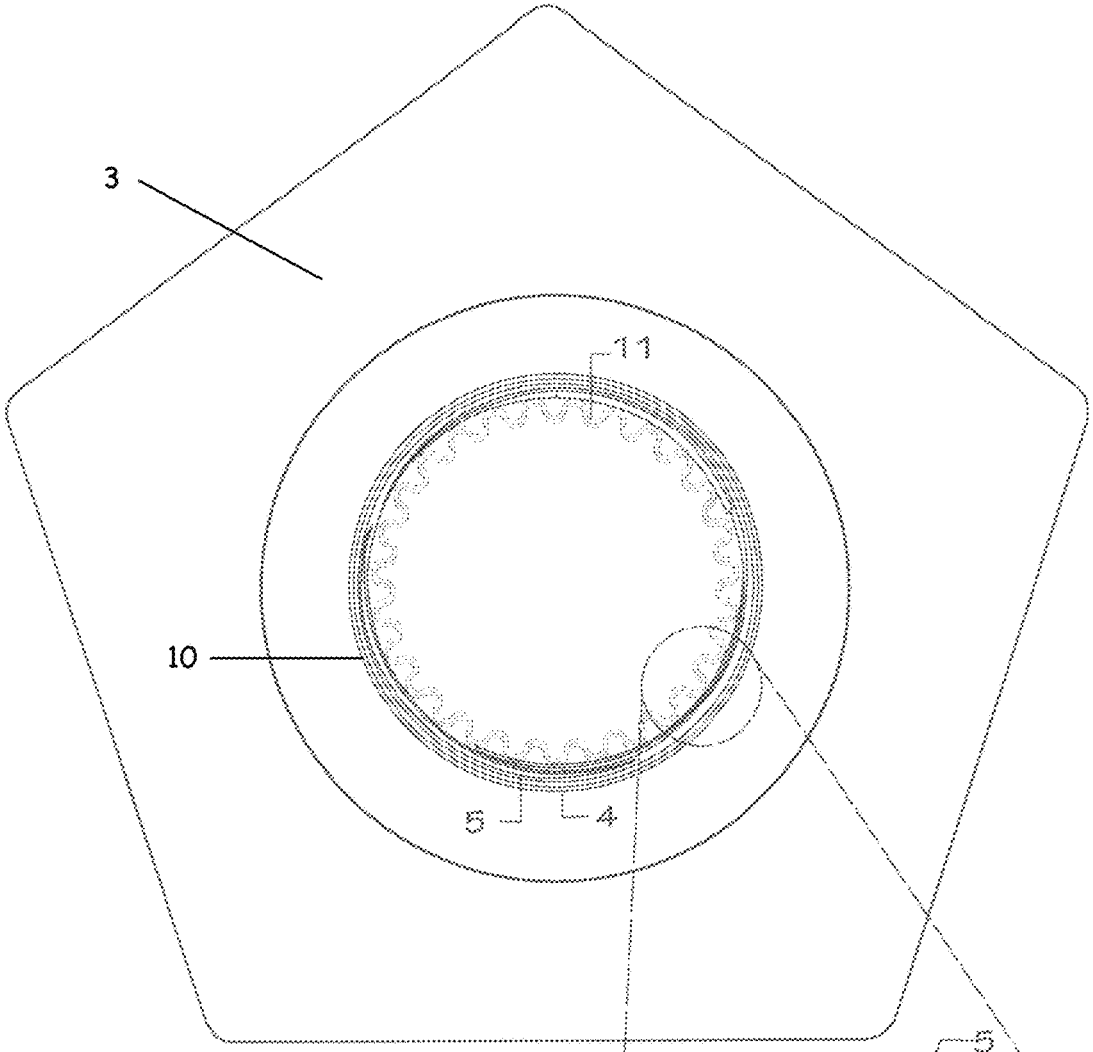
FIG. 5 Shows the plate with the locking cup holder locked into the cup attachment receptor.
Figure 5A:
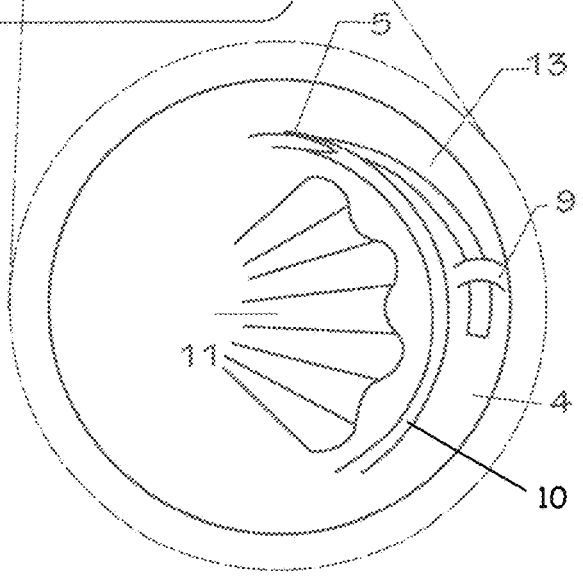
FIG. 5A Shows an expanded view of the locking mechanism.

FIGS. 5 and 5A are an overhead view of plate 3 with locking cup holder 5 placed in locking cup attachment receptor 4 and with locking cup holder 5 locked in place. User will align locking tab 13 with locking slot 9 and twist locking cup holder clockwise until locking tab slides into locking slot and thus secures locking cup holder 5 to locking cup attachment receptor 4. Once secured, locking cup holder 5 is ready to receive cup 6. Alternatively, cup 6 can be placed in locking cup holder 5 prior to coupling with locking cup attachment receptor. The lower base of cup 6 will be secured by inner cup sleeve 11 and the upper portion of cup 6 will be secured by outer cup sleeve. Gripping aperture 12 can be opened to allow placement of cup 6 or once cup is placed within locking cup holder will close to secure cup 6 within sleeve.

FIG. 6A is a view of cup lid 16 with external straw 14 stowed in storage location 17. Lid 16 is also shown with straw receptacle 15 located on the top of the lid to connect to internal straw 18 as shown in FIGS. 6B and 6C.

FIG. 6B shows an overhead view of cup 6 with lid 16 removed. Internal straw 18 is disposed along one side of the inside of the cup and is located to couple to straw receptacle 15 on lid 16. This coupling between internal straw 18, straw receptacle 15 and external straw 14 provide a direct connection to the bottom of the cup and allows the user to consume the liquid from the cup by using suction through the connected straws. The cup 6 can be used with lid 16 removed or in place.

FIG. 6C is a view of cup 6 as disclosed in the preferred embodiment. External straw 14 can be placed in straw receptacle 15 located on the top of lid 16 to connect to internal straw 18 to allow the user to drink liquids from the cup. Otherwise, external straw 14 can be stored in straw storage location 17. External straw 14 can be manufactured from any common materials including paper, plastic and metal. In the preferred embodiment, the straw is made of organic paper.

Figures 7A, 7B:
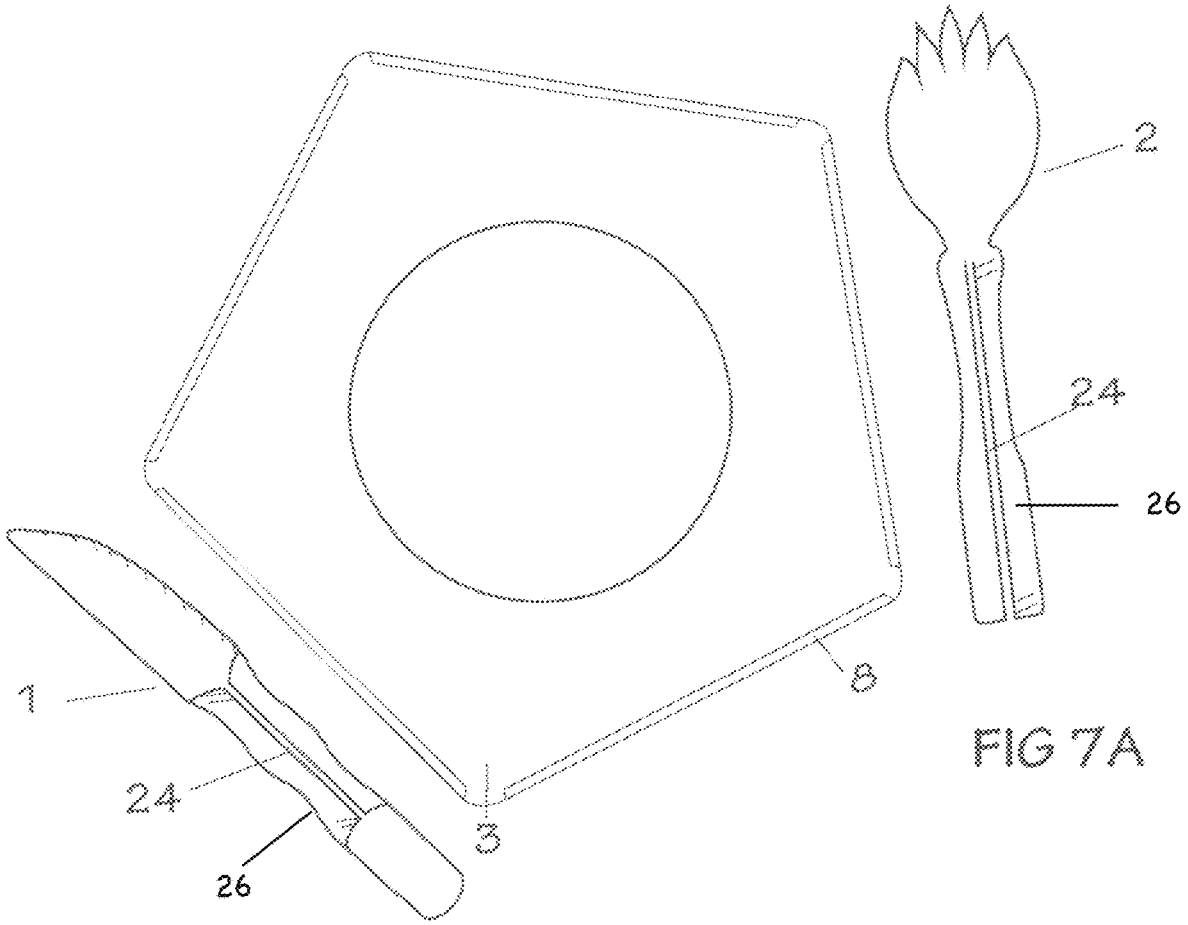
FIG. 7A Shows the utensil with the channel displayed.
FIG. 7B Shows the plate with edges for coupling with channel in utensils.

FIG. 7A is a detailed view of utensil 2. In this view, channel 24 is shown. Channel 24 provides a matching slot to receive edge 8 and lock utensil 2 to plate 3. In the preferred embodiment, channel 24 is a rectangular shape with edge 8 being a matching size to fit in channel 24 and lock utensil 2 securely to plate 3. Utensil 2 has handle 26 which is formed to be comfortable to hold in the user's hand. Handle 26 provides the user with a secure grip on utensil 2.

FIG. 7B is shows plate 3 with edge 8 ready to receive channel 24 in utensil 2 so that utensil 2 can be secured to the plate. Utensil 2 can be formed of any suitable disposable, recyclable or reusable material such as plastic, paper, wood, compostable/recycled material, metal, glass, ceramic or any other suitable material known in the art for manufacturing such articles.

Although the present invention has been described in relation to the above disclosed preferred embodiment, many modifications in design, materials and manufacturing are possible while still maintaining the novel claimed features and advantages of the invention. The preferred embodiment is not meant to limit the claims in any way, and the claims should be given the broadest possible interpretation consistent with the language of the disclosure on the whole.

The invention claimed is:

1. A portable plate comprising:

A plate with a front and a back side;

The front side being used for carrying items;

The back side being used by a person to support the plate with their hand;

The back side including a compartment defined by a compartment opening, compartment sides and a compartment bottom;

The compartment bottom and compartment sides forming a three dimensional compartment storage space between the plate front and plate back side;

The compartment opening having a removeable compartment cover that covers the compartment opening;

The compartment cover being attachably openable and closeable to cover the compartment opening and closes flush to the bottom of the plate;

The compartment storage space containing at least one adjustable strap that can placed around the persons hand to provide stability to the plate; and The plate including a location disposed on the front side of the plate for securely holding a cup comprising:

a locking cup attachment receptor with a raised circular wall having sides and a bottom and at least one locking slot for receiving a locking tab;

A circular locking cup holder for securely holding said cup, said locking cup holder comprising;

an outer cup sleeve with a base and circular vertical walls, apertures cut diagonally along the circular vertical walls of the outer cup sleeve, the apertures allowing inserting and removal of said cup from the locking cup holder, the apertures allowing cups of multiple sizes to be placed in the locking cup holder, and at least one locking tab disposed near the base of the locking cup holder, and a circular inner cup sleeve comprising vertical walls, said inner cup sleeve located concentrically within the outer cup sleeve, the locking tab and locking slot disposed to couple securely to each other when the locking cup attachment sleeve is placed within the locking cup attachment receptor and twisted axially, the locking cup holder securely gripping said cup when said cup is placed within the locking cup holder.

2. The portable plate of claim 1;

Wherein the cup includes a lid with an opening, an internal straw and an external straw;

Said internal straw being located inside the cup, the opening disposed to couple the external straw to the internal straw.

3. The portable plate of claim 1;

Wherein the plate includes an outer rim and an edge disposed at the outer rim;

the edge designed to couple with a matching channel disposed along the handle of a utensil;

when the edge is placed within the channel, the utensil is securely attached to the outer rim of the plate.

4. The utensil of claim 3, where the utensil has a grip formed to be fit comfortably and securely in the user's hand.

5. The portable plate of claim 1;

where the plate and cup are made of paper.

6. The portable plate of claim 1;

where the plate and cup are made of cardboard.

7. The portable plate of claim 1;

where the plate and cup are made of plastic.

8. The portable plate of claim 3;

where the utensil is a fork.

9. The portable plate of claim 3;

where the utensil is a spoon.

10. The portable plate of claim 3;

where the utensil is a knife.

11. The portable plate of claim 1;

Where the bottom of the locking cup attachment receptor includes an ornamental design.

* * * * *